US006932261B2

(12) United States Patent
Huang

(10) Patent No.: US 6,932,261 B2
(45) Date of Patent: Aug. 23, 2005

(54) PALM OPERATED NAIL EJECTOR

(75) Inventor: Chen-Fa Huang, Ta Li (TW)

(73) Assignee: Besco Pneumatic Corp., Ta Li (TW)

( * ) Notice: Subject to any disclaimer, the term of this patent is extended or adjusted under 35 U.S.C. 154(b) by 0 days.

(21) Appl. No.: 10/748,624

(22) Filed: Dec. 30, 2003

(65) Prior Publication Data

US 2004/0188491 A1 Sep. 30, 2004

(30) Foreign Application Priority Data

Mar. 31, 2003 (TW) ..... 92204987 U

(51) Int. Cl.[7] ..... B25C 1/00
(52) U.S. Cl. ..... 227/120; 227/130; 227/148
(58) Field of Search ..... 227/110, 119, 227/120, 130, 148

(56) References Cited

U.S. PATENT DOCUMENTS 3,438,449 A * 4/1969 Smith ..... 173/17
3,820,705 A * 6/1974 Beals ..... 227/113
4,741,467 A * 5/1988 Gassner et al. ..... 227/8
4,903,880 A * 2/1990 Austin et al. ..... 227/8
6,095,394 A * 8/2000 Wang-Kuan ..... 227/130
6,364,192 B1 * 4/2002 Lin ..... 227/113
6,598,775 B1 * 7/2003 Chen ..... 227/113
6,761,299 B2 * 7/2004 Caringella et al. ..... 227/10
6,779,697 B2 * 8/2004 Lin ..... 227/120
2004/0086450 A1 * 5/2004 Lin ..... 227/120

FOREIGN PATENT DOCUMENTS

GB 847388 * 9/1960 ..... 89/3

* cited by examiner

*Primary Examiner*—Rinaldi I. Rada
*Assistant Examiner*—Paul Durand
(74) *Attorney, Agent, or Firm*—Alan D. Kamrath; Nikolai & Mersereau, P.A.

(57) ABSTRACT

A nail ejector includes a main body; and a nail magazine mounted on an end of the main body. Thus, the nail ejector is pressed and operated by a user's one palm to eject the nails outward successively. In addition, the nail magazine contains multiple nails which are ejected outward from the shaft hole of the guide tube successively without having to feed the nails repeatedly, thereby greatly saving the working time, and thereby enhancing the working efficiency.

1 Claim, 5 Drawing Sheets

PALM OPERATED NAIL EJECTOR

BACKGROUND OF THE INVENTION

1. Field of the Invention

The present invention relates to a nail ejector, and more particularly to a nail ejector that is pressed and operated by a user's one palm to eject the nails outward successively.

2. Description of the Related Art

A conventional nail ejector in accordance with the prior art is disclosed in the Taiwanese Patent Publication No. 516480 and comprises a main body 2, a socket 3 mounted in a limit portion 23 of the main body 2, a guide tube 5 mounted in a chamber 31 of the socket 3, and a shaft 26 movably mounted in the main body 2 to push the nail. Thus, a user's one palm presses the main body 2 to move the shaft 26 downward to push the nail so as to eject the nail outward.

However, the user's one hand cannot hold the main body 2 rigidly and stably, so that the nail is easily deflected when being ejected outward. In addition, the conventional nail ejector does not have a nail magazine, so that the conventional nail ejector can only eject one nail at a time, thereby causing inconvenience to the user.

SUMMARY OF THE INVENTION

The primary objective of the present invention is to provide a nail ejector that is pressed and operated by a user's one palm to eject the nails outward successively.

Another objective of the present invention is to provide a nail ejector, wherein the nail magazine contains multiple nails which are ejected outward from the shaft hole of the guide tube successively without having to feed the nails repeatedly, thereby saving the working time, and thereby enhancing the working efficiency.

A further objective of the present invention is to provide a nail ejector, wherein the guide tube of the nail magazine is secured on the connecting sleeve and the first end of the connecting sleeve is rotatably mounted on the mounting seat of the main body, so that the nail magazine is rotatable about the shaft through 360 degrees so as to adjust the included angle between the main body and the nail magazine, thereby facilitating the user operating the nail ejector.

A further objective of the present invention is to provide a nail ejector, wherein each of the positioning balls is rotated with the first end of the connecting sleeve and is detachably locked in a respective one of the positioning bores of the mounting seat, so that the first end of the connecting sleeve is positioned on the mounting seat of the main body temporarily to prevent the connecting sleeve from being rotated freely.

A further objective of the present invention is to provide a nail ejector, wherein the main body is held by the user's one hand, and the nail magazine is held by the user's other hand, so that the user can operate the nail ejector exactly.

In accordance with the present invention, there is provided a nail ejector, comprising:

a main body; and a nail magazine mounted on an end of the main body.

Further benefits and advantages of the present invention will become apparent after a careful reading of the detailed description with appropriate reference to the accompanying drawings.

DETAILED DESCRIPTION OF THE INVENTION

Figure 1:
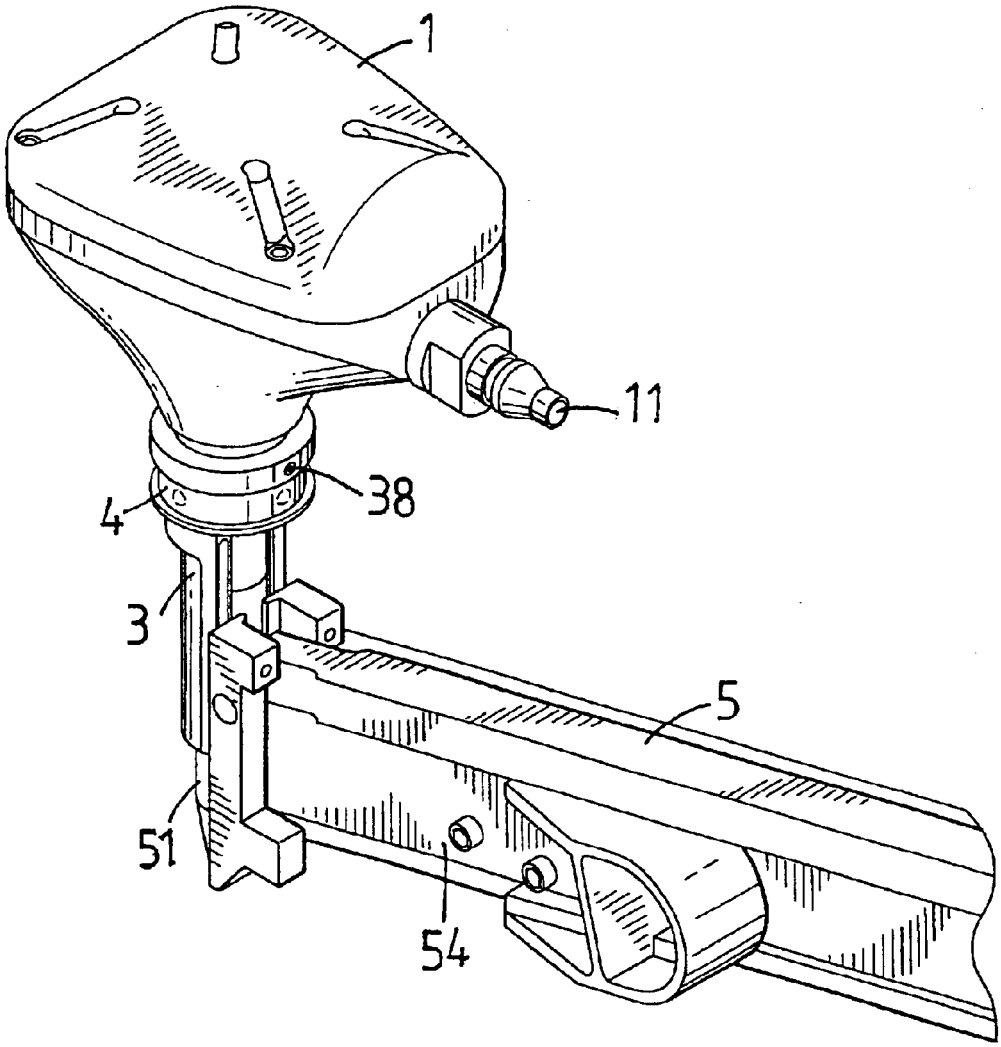
FIG. 1 is a perspective view of a nail ejector in accordance with the preferred embodiment of the present invention.
Figure 2:
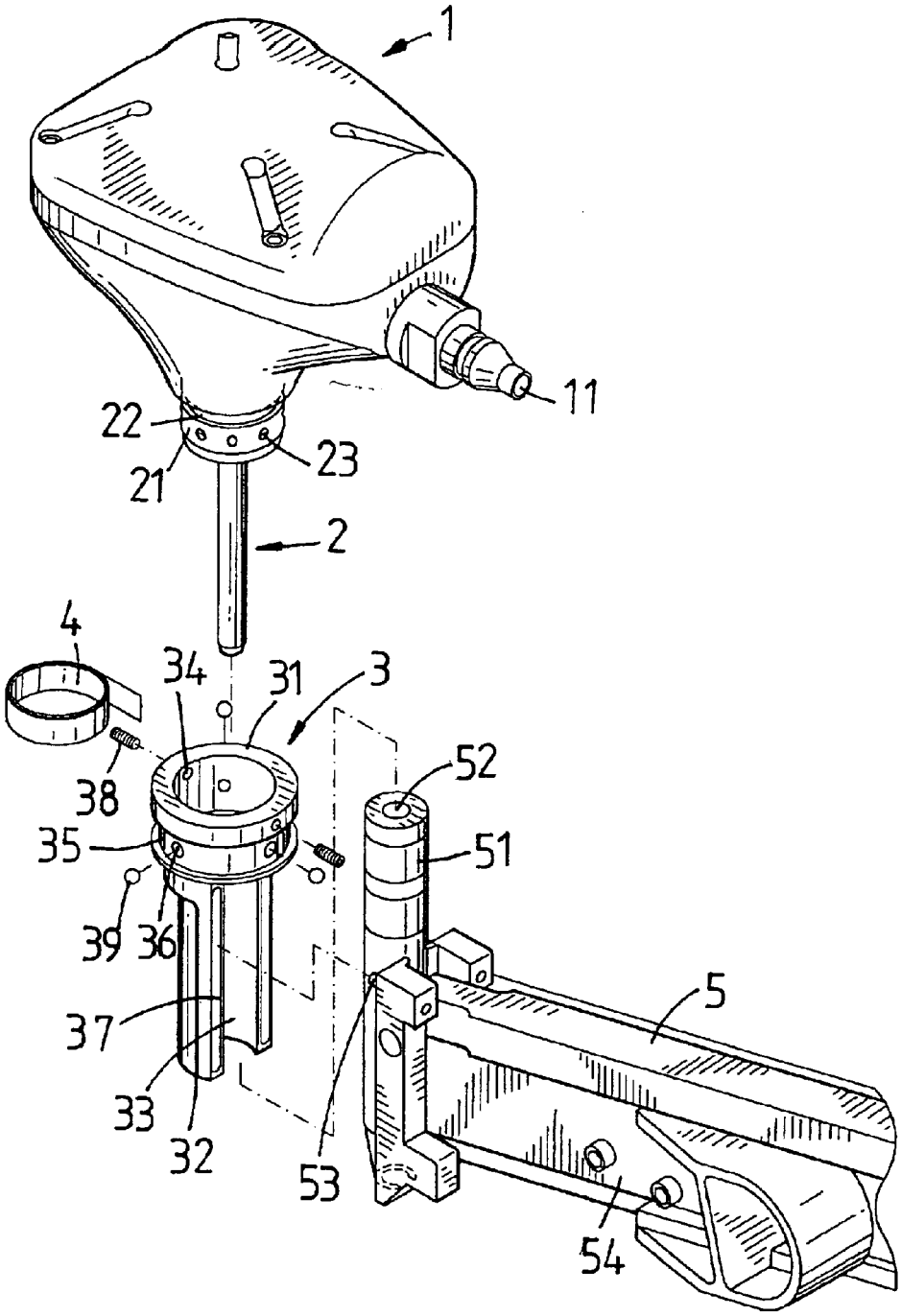
FIG. 2 is an exploded perspective view of the nail ejector as shown in FIG. 1.
Figure 3:
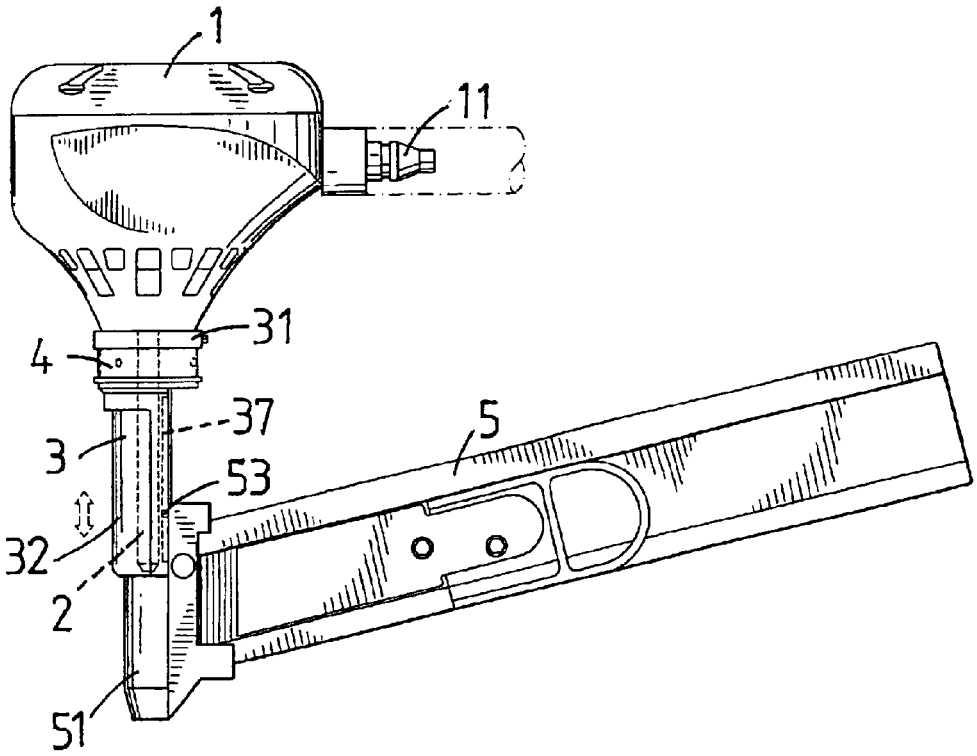
FIG. 3 is a plan view of the nail ejector as shown in FIG. 1.
Figure 4:
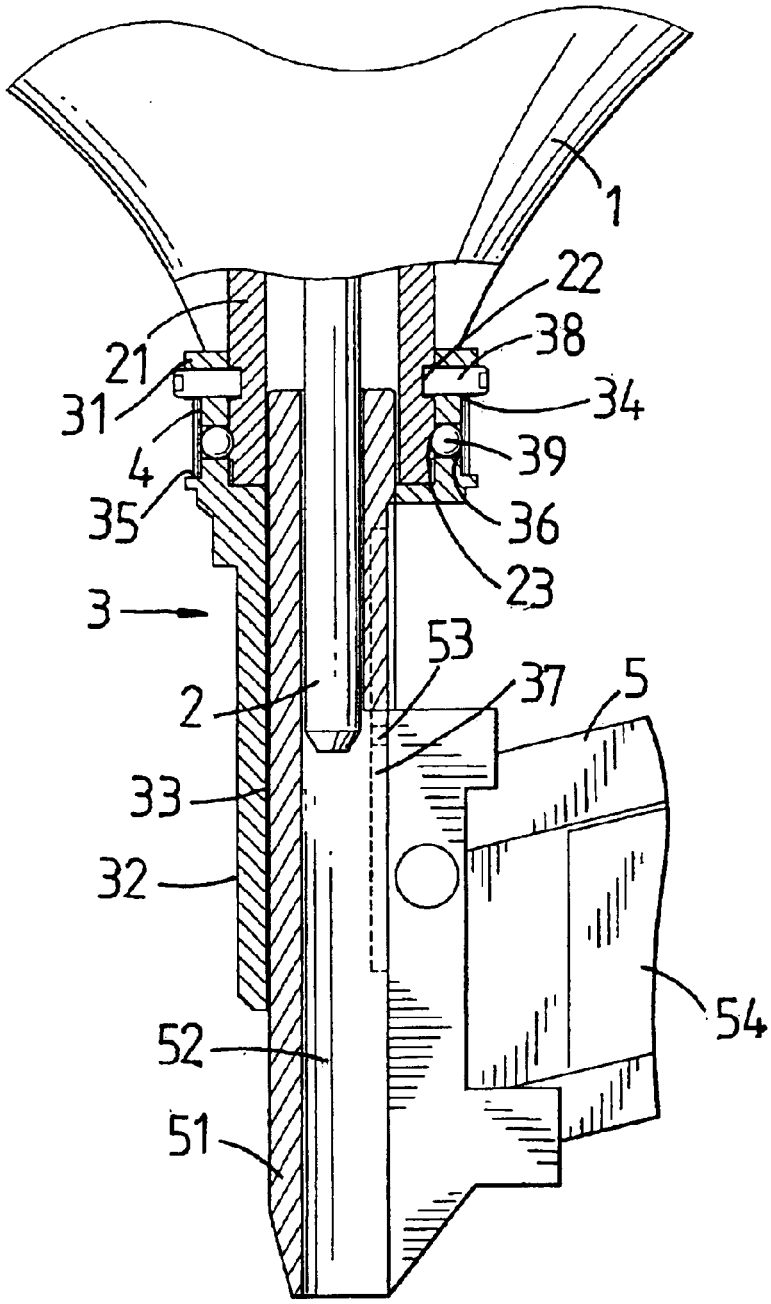
FIG. 4 is a partially cut-away enlarged plan cross-sectional view of the nail ejector as shown in FIG. 3.

Referring to the drawings and initially to FIGS. 1–4, a nail ejector in accordance with the preferred embodiment of the present invention comprises a main body 1, a shaft 2, a connecting sleeve 3, a nail magazine 5.

The main body 1 has a side formed with an air inlet 11 and has an end provided with a mounting seat 21 having a periphery formed with an annular locking groove 22 and a plurality of positioning bores 23.

The shaft 2 is mounted in the main body 1 and has a distal end protruded outward from the mounting seat 21.

The connecting sleeve 3 is mounted on the main body 1 and has an inside formed with a receiving chamber 33. The connecting sleeve 3 has an enlarged first end 31 rotatably mounted on the mounting seat 21 of the main body 1 and having a periphery formed with a plurality of through holes 34 and an annular retaining groove 35. The through holes 34 of the connecting sleeve 3 align with the locking groove 22 of the mounting seat 21. The nail ejector further comprises a plurality of locking members 38 each extended through a respective one of the through holes 34 of the connecting sleeve 3 and each rested on the locking groove 22 of the mounting seat 21, so that the first end 31 of the connecting sleeve 3 is rotatably mounted on the mounting seat 21 of the main body 1. The retaining groove 35 of the connecting sleeve 3 is formed a plurality of positioning holes 36 aligning with the positioning bores 23 of the mounting seat 21. The nail ejector further comprises a plurality of positioning balls 39 each movably mounted in a respective one of the positioning holes 36 of the connecting sleeve 3 and each detachably locked in a respective one of the positioning bores 23 of the mounting seat 21, so that the first end 31 of the connecting sleeve 3 is positioned on the mounting seat 21 of the main body 1 temporarily. The nail ejector further comprises an annular elastic plate 4 mounted in the retaining groove 35 of the connecting sleeve 3 and urged on the positioning balls 39 to position the positioning balls 39 in the positioning holes 36 of the connecting sleeve 3. The connecting sleeve 3 has a semi-circular second end 32 having two opposite distal ends each formed with an elongated limit slot 37.

The nail magazine 5 is mounted on the connecting sleeve 3 and has an end provided with a guide tube 51 movably mounted in the receiving chamber 33 of the connecting sleeve 3. The guide tube 51 of the nail magazine 5 is formed with a shaft hole 52, and the shaft 2 is movably mounted in the shaft hole 52 of the guide tube 51. The guide tube 51 of the nail magazine 5 has a periphery formed with two opposite limit blocks 53 each slidably mounted in a respective limit slot 37 of the connecting sleeve 3. The nail magazine 5 has a side provided with a slidable nail push member 54 to push nails (not shown) contained in the nail magazine 5 into the shaft hole 52 of the guide tube 51.

When in use, the nail push member 54 is slidable in the nail magazine 5 to push the nails (not shown) contained in the nail magazine 5 into the shaft hole 52 of the guide tube 51. Then, the user's one palm applies a downward force on the main body 1 to press the shaft 2 downward, so that the shaft 2 is moved downward in the shaft hole 52 of the guide tube 51 to push the nails. Thus, the air from the air inlet 11 of the main body 1 pushes the shaft 2 to eject the nails outward from the shaft hole 52 of the guide tube 51.

Figure 5:
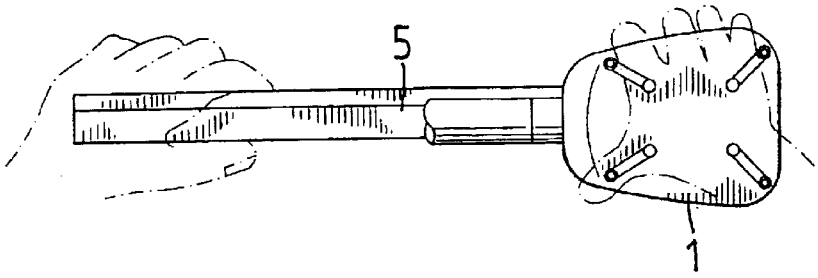
FIG. 5 is a schematic top plan operational view of the nail ejector as shown in FIG. 1.
Figure 6:
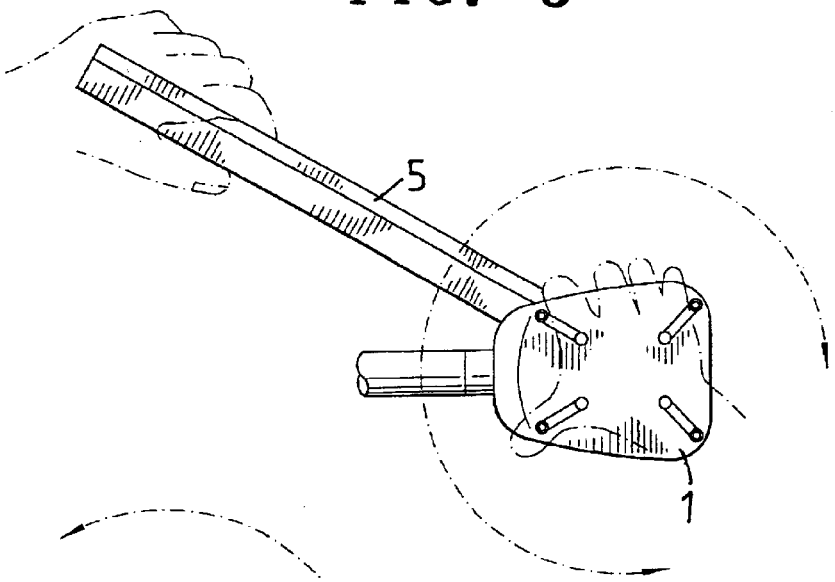
FIG. 6 is a schematic operational view of the nail ejector as shown in FIG. 5.
Figure 7:
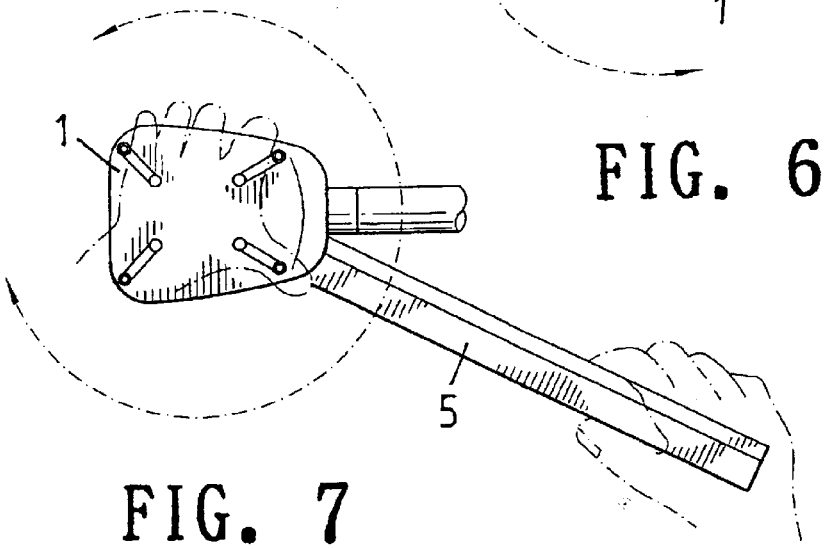
FIG. 7 is a schematic operational view of the nail ejector as shown in FIG. 5.

In such a manner, the nail magazine 5 contains multiple nails which are ejected outward from the shaft hole 52 of the guide tube 51 successively without having to feed the nails repeatedly, thereby saving the working time, and thereby enhancing the working efficiency. In addition, the guide tube 51 of the nail magazine 5 is secured on the connecting sleeve 3 and the first end 31 of the connecting sleeve 3 is rotatably mounted on the mounting seat 21 of the main body 1, so that the nail magazine 5 is rotatable about the shaft 2 through 360 degrees so as to adjust the included angle between the main body 1 and the nail magazine 5 as shown in FIGS. 5–7, thereby facilitating the user operating the nail ejector. Further, each of the positioning balls 39 is rotated with the first end 31 of the connecting sleeve 3 and is detachably locked in a respective one of the positioning bores 23 of the mounting seat 21, so that the first end 31 of the connecting sleeve 3 is positioned on the mounting seat 21 of the main body 1 temporarily to prevent the connecting sleeve 3 from being rotated freely. Further, the main body 1 is held by the user's one hand, and the nail magazine 5 is held by the user's other hand, so that the user can operate the nail ejector exactly.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A nailing tool comprised of:

a main body having an end provided with a mounting seat having a periphery formed with an annular locking groove and a plurality of positioning bores;

a shaft for ejecting a mounted in the main body and having a distal end protruded outward from the mounting seat;

a connecting sleeve mounted on the main body and having an inside formed with a receiving chamber;

the connecting sleeve having an enlarged first end rotatably mounted on the mounting seat of the main body and a semi-circular second end having two opposite distal ends each formed with an elongated limit slot;

the first end of the connecting sleeve having a periphery formed with a plurality of through holes aligning with the annular locking groove of the mounting seat and having an outer wall formed with an annular retaining groove formed a plurality of positioning holes aligning with the positioning bores of the mounting seat;

a plurality of locking members each extended through a respective one of the through holes of the connecting sleeve and each rested on the annular locking groove of the mounting seat, so that the first end of the connecting sleeve is rotatably mounted on the mounting seat of the main body;

a plurality of positioning balls each movably mounted in a respective one of the positioning holes of the connecting sleeve and each detachably locked in a respective one of the positioning bores of the mounting seat, so that the first end of the connecting sleeve is positioned on the mounting seat of the main body temporarily;

an annular elastic plate mounted in the retaining groove of the connecting sleeve and urged on the positioning balls to position the positioning balls in the positioning holes of the connecting sleeve;

a nail magazine mounted on the connecting sleeve and having an end provided with a guide tube movably mounted in the receiving chamber of the connecting sleeve and formed with a shaft hole;

the shaft being movably mounted in the shaft hole of the guide tube which is located between the shaft and the connecting sleeve;

the guide tube of the nail magazine having a periphery formed with two opposite limit blocks each slidably mounted in a respective limit slot of the connecting sleeve so that the connecting sleeve is movable linearly relative to the guide tube of the nail magazine.

* * * * *